US006106697A

United States Patent [19]

Swan et al.

[11] Patent Number: 6,106,697

[45] Date of Patent: Aug. 22, 2000

[54] TWO STAGE FLUID CATALYTIC CRACKING PROCESS FOR SELECTIVELY PRODUCING $C_2$ TO $C_4$ OLEFINS

[75] Inventors: George A. Swan; Michael W. Bedell, both of Baton Rouge, La.; Paul K. Ladwig, Randolph, N.J.; John E. Asplin, Southampton, United Kingdom; Gordon F. Stuntz, Baton Rouge, La.; William A. Wachter, Baton Rouge, La.; Brian Erik Henry, Baton Rouge, La.

[73] Assignee: Exxon Research and Engineering Company, Florham Park, N.J.

[21] Appl. No.: 09/073,084

[22] Filed: May 5, 1998

[51] Int. Cl.[7] ..... C10G 51/02

[52] U.S. Cl. ..... 208/77; 208/67; 208/72; 208/74; 585/324

[58] Field of Search ..... 208/74, 77, 67, 208/72; 585/324

[56] References Cited

U.S. PATENT DOCUMENTS

| | | | |
|---|---|---|---|
| 3,761,391 | 9/1973 | Conner | 208/74 |
| 3,775,141 | 11/1973 | Youngblood et al. | 208/56 |
| 3,776,838 | 12/1973 | Youngblood et al. | 208/77 |
| 3,891,540 | 6/1975 | Demmel et al. | 208/77 |
| 3,894,933 | 7/1975 | Owen et al. | 208/74 |
| 3,928,172 | 12/1975 | Davis, Jr. et al. | 208/77 |
| 4,172,812 | 10/1979 | Winter | 208/72 |
| 4,830,728 | 5/1989 | Herbst et al. | 208/78 |
| 5,026,935 | 6/1991 | Leyshon et al. | 585/315 |
| 5,026,936 | 6/1991 | Leyshon et al. | 585/315 |
| 5,043,522 | 8/1991 | Leyshon et al. | 585/651 |
| 5,059,735 | 10/1991 | Nemet-Mavrodin | 585/418 |
| 5,069,776 | 12/1991 | Biswas et al. | 208/120 |
| 5,171,921 | 12/1992 | Gaffney et al. | 585/653 |
| 5,472,594 | 12/1995 | Tsang et al. | 208/114 |
| 5,723,040 | 3/1998 | Letzsch et al. | 208/113 |
| 5,770,043 | 6/1998 | Ellis et al. | 208/76 |
| 5,770,044 | 6/1998 | Ellis et al. | 208/77 |

FOREIGN PATENT DOCUMENTS 0347 003 B1 8/1996 European Pat. Off. .

*Primary Examiner*—Walter D. Griffin
*Attorney, Agent, or Firm*—Henry E. Naylor

[57] ABSTRACT

$C_2$ to $C_4$ olefins are selectively produced from a gas oil or resid in a two stage process. The gas oil or resid is reacted in a first stage comprised of a fluid catalytic cracking unit wherein it is converted in the presence of conventional large pore zeolitic catalyst to reaction products, including a naphtha boiling range stream. The naphtha boiling range stream is introduced into a second stage comprised of a process unit containing a reaction zone, a stripping zone, a catalyst regeneration zone, and a fractionation zone. The naphtha feedstream is contacted in the reaction zone with a catalyst containing from about 10 to 50 wt. % of a crystalline zeolite having an average pore diameter less than about 0.7 nanometers at reaction conditions which include temperatures ranging from about 500 to 650° C. and a hydrocarbon partial pressure from about 10 to 40 psia. Vapor products are collected overhead and the catalyst particles are passed through the stripping zone on the way to the catalyst regeneration zone. Volatiles are stripped with steam in the stripping zone and the catalyst particles are sent to the catalyst regeneration zone where coke is burned from the catalyst, which is then recycled to the reaction zone.

8 Claims, No Drawings

TWO STAGE FLUID CATALYTIC CRACKING PROCESS FOR SELECTIVELY PRODUCING $C_2$ TO $C_4$ OLEFINS

FIELD OF THE INVENTION

The present invention relates to a two stage process for selectively producing $C_2$ to $C_4$ olefins from a gas oil or resid. The gas oil or resid is reacted in a first stage comprised of a fluid catalytic cracking unit wherein it is converted in the presence of conventional large pore zeolitic catalyst to reaction products, including a naphtha boiling range stream. The naphtha boiling range stream is introduced into a second stage comprised of a process unit containing a reaction zone, a stripping zone, a catalyst regeneration zone, and a fractionation zone. The naphtha feedstream is contacted in the reaction zone with a catalyst containing from about 10 to 50 wt. % of a crystalline zeolite having an average pore diameter less than about 0.7 nanometers at reaction conditions which include temperatures ranging from about 500 to 650° C. and a hydrocarbon partial pressure from about 10 to 40 psia. Vapor products are collected overhead and the catalyst particles are passed through the stripping zone on the way to the catalyst regeneration zone. Volatiles are stripped with steam in the stripping zone and the catalyst particles are sent to the catalyst regeneration zone where coke is burned from the catalyst, which is then recycled to the reaction zone.

BACKGROUND OF THE INVENTION

The need for low emissions fuels has created an increased demand for light olefins for use in alkylation, oligomerization, MTBE and ETBE synthesis processes. In addition, a low cost supply of light olefins, particularly propylene, continues to be in demand to serve as feedstock for polyolefin, particularly polypropylene production.

Fixed bed processes for light paraffin dehydrogenation have recently attracted renewed interest for increasing olefin production. However, these types of processes typically require relatively large capital investments as well as high operating costs. It is therefore advantageous to increase olefin yield using processes, which require relatively small capital investment. It would be particularly advantageous to increase olefin yield in catalytic cracking processes.

Catalytic cracking is an established and widely used process in the petroleum refining industry for converting petroleum oils of relatively high boiling point to more valuable lower boiling products, including gasoline and middle distillates, such as kerosene, jet fuel and heating oil. The pre-eminent catalytic cracking process now in use is the fluid catalytic cracking process (FCC) in which a pre-heated feed is brought into contact with a hot cracking catalyst which is in the form of a fine powder, typically having a particle size of about 10–300 microns, usually about 60–70 microns, for the desired cracking reactions to take place. During the cracking, coke and hydrocarbonaceous material are deposited on the catalyst particles. This results in a loss of catalyst activity and selectivity. The coked catalyst particles, and associated hydrocarbon material, are subjected to a stripping process, usually with steam, to remove as much of the hydrocarbon material as technically and economically feasible. The stripped particles containing non-strippable coke, are removed from the stripper and sent to a regenerator where the coked catalyst particles are regenerated by being contacted with air, or a mixture of air and oxygen, at an elevated temperature. This results in the combustion of the coke which is a strongly exothermic reaction which, besides removing the coke, serves to heat the catalyst to the temperatures appropriate for the endothermic cracking reaction. The process is carried out in an integrated unit comprising the cracking reactor, the stripper, the regenerator, and the appropriate ancillary equipment. The catalyst is continuously circulated from the reactor or reaction zone, to the stripper and then to the regenerator and back to the reactor. The circulation rate is typically adjusted relative to the teed rate of the oil to maintain a heat balanced operation in which the heat produced in the regenerator is sufficient for maintaining the cracking reaction with the circulating regenerated catalyst being used as the heat transfer medium. Typical fluid catalytic cracking processes are described in the monograph Fluid Catalytic Cracking with Zeolite Catalysts, Venuto, P. B. and Habib, E. T., Marcel Dekker Inc. N.Y. 1979, which is incorporated herein by reference. As described in this monograph, catalysts which are conventionally used are based on zeolites, especially the large pore synthetic faujasites, zeolites X and Y.

Typical feeds to a catalytic cracker can generally be characterized as being a relatively high boiling oil or residuum, either on its own, or mixed with other fractions, also usually of a relatively high boiling point. The most common feeds are gas oils, that is, high boiling, non-residual oils, with an initial boiling point usually above about 230° C., more commonly above about 350° C., with end points of up to about 620° C. Typical gas oils include straight run (atmospheric) gas oil, vacuum gas oil, and coker gas oils.

While such conventional fluid catalytic cracking processes are suitable for producing conventional transportation fuels, such fuels are generally unable to meet the more demanding requirements of low emissions fuels and chemical feedstock production. To augment the volume of low emission fuels, it is desirable to increase the amounts of light olefins, such as propylene, iso- and normal butylenes, and isoamylene. The propylene, isobutylene, and isoamylene can be reacted with methanol to form methyl-propyl-ethers, methyl tertiary butyl ether (MTBE), and tertiary amyl methyl ether (TAME). These are high octane blending components which can be added to gasoline to satisfy oxygen requirements mandated by legislation. In addition to enhancing the volume and octane number of gasoline, they also reduce emissions. It is particularly desirable to increase the yield of ethylene and propylene which are valuable as a chemical raw material. Conventional fluid catalytic cracking does not produce large enough quantities of these light olefins, particularly ethylene. Consequently, there exits a need in the art for methods of producing larger quantities of ethylene and propylene for chemicals raw materials, as well as other light olefins for low emissions transportation fuels, such as gasoline and distillates.

U.S. Pat. No. 4,830,728 discloses a fluid catalytic cracking (FCC) unit that is operated to maximize olefin production. The FCC unit has two separate risers into which a different feed stream is introduced. The operation of the risers is designed so that a suitable catalyst will act to convert a heavy gas oil in one riser and another suitable catalyst will act to crack a lighter olefin/naphtha feed in the other riser. Conditions within the heavy gas oil riser can be modified to maximize either gasoline or olefin production. The primary means of maximizing production of the desired product is by using a specified catalyst.

Also, U.S. Pat. No. 5,026,936 to Arco teaches a process for the preparation of propylene from $C_4$ or higher feeds by a combination of cracking and metathesis wherein the higher hydrocarbon is cracked to form ethylene and propylene and at least a portion of the ethylene is metathesized to propylene. See also, U.S. Pat. Nos. 5,026,935 and 5,043,522.

U.S. Pat. No. 5,069,776 teaches a process for the conversion of a hydrocarbonaccous feedstock by contacting the feedstock with a moving bed of a zeolitic catalyst comprising a zeolite with a pore diameter of 0.3 to 0.7 nm, at a temperature above about 500° C. and at a residence time less than about 10 seconds. Olefins are produced with relatively little saturated gaseous hydrocarbons being formed. Also, U.S. Pat. No. 3,928,172 to Mobil teaches a process for converting hydrocarbonaceous feedstocks wherein olefins are produced by reacting said feedstock in the presence of a ZSM-5 catalyst.

A problem inherent in producing olefin products using FCC units is that the process depends upon a specific catalyst balance to maximize production. In addition, even if a specific catalyst balance can be maintained to maximize overall olefin production, olefin selectivity is generally low due to undesirable side reactions, such as extensive cracking, isomerization, aromatization and hydrogen transfer reactions. Therefore, it is desirable to maximize olefin production in a process that allows a high degree of control over the selectivity of $C_2$, $C_3$ and $C_4$ olefins.

SUMMARY OF THE INVENTION

In accordance with the present invention there is provided a two stage process for selectively producing $C_2$ to $C_4$ olefins from a gas oil or resid. The gas oil or resid is reacted in a first stage comprised of a fluid catalytic cracking unit wherein it is converted in the presence of conventional large pore zeolitic catalyst to reaction products, including a naphtha boiling range stream. The naphtha boiling range stream is introduced into a second stage comprised of a process unit comprised of a reaction zone, a stripping zone, a catalyst regeneration zone, and a fractionation zone. The naphtha feedstream is contacted in the reaction zone with a catalyst containing from about 10 to 50 wt. % of a crystalline zeolite having an average pore diameter less than about 0.7 nanometers at reaction conditions which include temperatures ranging from about 500 to 650° C. and a hydrocarbon partial pressure from about 10 to 40 psia. Vapor products are collected overhead and the catalyst particles are passed through the stripping zone on the way to the catalyst regeneration zone. Volatiles are stripped with steam in the stripping zone and the catalyst particles are sent to the catalyst regeneration zone where coke is burned from the catalyst, which is then recycled to the reaction zone.

In another preferred embodiment of the present invention the second stage catalyst is a ZSM-5 type catalyst.

In still another preferred embodiment of the present invention the second stage feedstock contains about 10 to 30 wt. % paraffins, and from about 20 to 70 wt. % olefins.

In yet another preferred embodiment of the present invention the second stage reaction zone is operated at a temperature from about 525° C. to about 600° C.

DETAILED DESCRIPTION OF THE INVENTION

The feedstream of the first stage of the present invention is preferably a hydrocarbon fraction having an initial ASTM boiling point of about 600° F. Such hydrocarbon fractions include gas oils (including vacuum gas oils), thermal oils, residual oils, cycle stocks, topped whole crudes, tar sand oils, shale oils, synthetic fuels, heavy hydrocarbon fractions derived from the destructive hydrogenation of coal, tar, pitches, asphalts, and hydrotreated feed stocks derived from any of the foregoing.

The feed is reacted (converted) in a first stage, preferably in a fluid catalytic cracking reactor vessel where it is contacted with a catalytic cracking catalyst that is continuously recycled.

The feed can be mixed with steam or an inert gas at such conditions that will form a highly atomized stream of a vaporous hydrocarbon-catalyst suspension which undergoes reaction. Preferably, this reacting suspension flows through a riser into the reactor vessel. The reaction zone vessel is preferably operated at a temperature of about 800–1200° F. and a pressure of about 0–100 psig.

The catalytic cracking reaction is essentially quenched by separating the catalyst from the vapor. The separated vapor comprises the cracked hydrocarbon product, and the separated catalyst contains a carbonaceous material (i.e., coke) as a result of the catalytic cracking reaction.

The coked catalyst is preferably recycled to contact additional hydrocarbon feed after the coke material has been removed. Preferably, the coke is removed from the catalyst in a regenerator vessel by combusting the coke from the catalyst. Preferably, the coke is combusted at a temperature of about 900–1400° F. and a pressure of about 0–100 psig. After the combustion step, the regenerated catalyst is recycled to the riser for contact with additional hydrocarbon feed.

The catalyst which is used in the first stage of this invention can be any catalyst which is typically used to catalytically "crack" hydrocarbon feeds. It is preferred that the catalytic cracking catalyst comprise a crystalline tetrahedral framework oxide component. This component is used to catalyze the breakdown of primary products from the catalytic cracking reaction into clean products such as naphtha for fuels and olefins for chemical feedstocks. Preferably, the crystalline tetrahedral framework oxide component is selected from the group consisting of zeolites, tectosilicates, tetrahedral aluminophophates (AlPOs) and tetrahedral silicoaluminophosphates (SAPOs). More preferably, the crystalline framework oxide component is a zeolite.

Zeolites which can be employed in the first stage catalysts of the present invention include both natural and synthetic zeolites with average pore diameters greater than about 0.7 nm. These zeolites include gmelinite, chabazite, dachiardite, clinoptilolite, faujasite, heulandite, analcite, levynite, erionite, sodalite, cancrinite, nepheline, lazurite, scolecite, natrolite, offretite, mesolite, mordenite, brewsterite, and ferrierite. Included among the synthetic zeolites are zeolites X, Y, A, L, ZK-4, ZK-5, B, E, F, H, J, M, Q, T, W, Z, alpha, beta, and omega, and USY zeolites. USY zeolites are preferred.

In general, aluminosilicate zeolites are effectively used in this invention. However, the aluminum as well as the silicon component can be substituted for other framework components. For example, the aluminum portion can be replaced by boron, gallium, titanium or trivalent metal compositions which are heavier than aluminum. Germanium can be used to replace the silicon portion.

The catalytic cracking catalyst used in the first stage of this invention can further comprise an active porous inorganic oxide catalyst framework component and an inert catalyst framework component. Preferably, each component of the catalyst is held together by use of an inorganic oxide matrix component.

The active porous inorganic oxide catalyst framework component catalyzes the formation of primary products by cracking hydrocarbon molecules that are too large to fit inside the tetrahedral framework oxide component. The active porous inorganic oxide catalyst framework component of this invention is preferably a porous inorganic oxide that cracks a relatively large amount of hydrocarbons into lower molecular weight hydrocarbons as compared to an acceptable thermal blank. A low surface area silica (e.g., quartz) is one type of acceptable thermal blank. The extent of cracking can be measured in any of various ASTM tests such as the MAT (microactivity test, ASTM # D3907–8). Compounds such as those disclosed in Greensfelder, B. S., et al., *Industrial and Engineering Chemistry, pp.* 2573–83, November 1949, are desirable. Alumina, silica-alumina and silica-alumina-zirconia compounds are preferred.

The inert catalyst framework component densifies, strengthens and acts as a protective thermal sink. The inert catalyst framework component used in this invention preferably has a cracking activity that is not significantly greater than the acceptable thermal blank. Kaolin and other clays as well as a-alumina, titania, zirconia, quartz and silica are examples of preferred inert components. The inorganic oxide matrix component binds the catalyst components together so that the catalyst product is hard enough to survive interparticle and reactor wall collisions. The inorganic oxide matrix can be made from an inorganic oxide sol or gel which is dried to "glue" the catalyst components together. Preferably, the inorganic oxide matrix will be comprised of oxides of silicon and aluminum. It is also preferred that separate alumina phases be incorporated into the inorganic oxide matrix. Species of aluminum oxyhydroxides-g-alumina, boehmite, diaspore, and transitional aluminas such as a-alumina, b-alumina, g-alumina, d-alumina, e-alumina, k-alumina, and r-alumina can be employed. Preferably, the alumina species is an aluminum trihydroxide such as gibbsite, bayerite, nordstrandite, or doyelite. The matrix material may also contain phosphorous or aluminum phosphate.

A naphtha boiling range fraction of the product stream from the fluid catalytic cracking unit is used as the feedstream to a second reaction stage to selectively produce $C_2$ to $C_4$ olefins. This feedstream for the second reaction stage is preferably one that is suitable for producing the relatively high $C_2$, $C_3$, and $C_4$ olefin yields. Such streams are those boiling in the naphtha range and containing from about 5 wt. % to about 35 wt. %, preferably from about 10 wt. % to about 30 wt. %, and more preferably from about 10 to 25 wt. % paraffins, and from about 15 wt. %, preferably from about 20 wt. % to about 70 wt. % olefins. The feed may also contain naphthenes and aromatics. Naphtha boiling range streams are typically those having a boiling range from about 65° F. to about 430° F., preferably from about 65° F. to about 300° F. Naphtha streams from other sources in the refinery can be blended with the aforementioned feedstream and fed to this second reaction stage.

The second stage is performed in a process unit comprised of a reaction zone, a stripping zone, a catalyst regeneration zone, and a fractionation zone. The naphtha feedstream is fed into the reaction zone where it contacts a source of hot, regenerated catalyst. The hot catalyst vaporizes and cracks the feed at a temperature from about 500° C. to 650° C., preferably from about 500° C. to 600° C. The cracking reaction deposits carbonaceous hydrocarbons, or coke, on the catalyst, thereby deactivating the catalyst. The cracked products are separated from the coked catalyst and sent to a fractionator. The coked catalyst is passed through the stripping zone where volatiles are stripped from the catalyst particles with steam. The stripping can be preformed under low severity conditions in order to retain adsorbed hydrocarbons for heat balance. The stripped catalyst is then passed to the regeneration zone where it is regenerated by burning coke on the catalyst in the presence of an oxygen containing gas, preferably air. Decoking restores catalyst activity and simultaneously heats the catalyst to, e.g., 650° C. to 750° C. The hot catalyst is then recycled to the reaction zone to react with fresh naphtha feed. Flue gas formed by burning coke in the regenerator may be treated for removal of particulates and for conversion of carbon monoxide, after which the flue gas is normally discharged into the atmosphere. The cracked products from the reaction zone are sent to a fractionation zone where various products are recovered, particularly $C_2$, $C_3$, and $C_4$ fractions.

While attempts have been made to increase light olefins yields in the FCC process unit itself, the practice of the present invention uses its own distinct process unit, as previously described, which receives naphtha from a suitable source in the refinery. The reaction zone is operated at process conditions that will maximize $C_2$ to $C_4$ olefin, particularly propylene, selectivity with relatively high conversion of $C_5$+ olefins. Catalysts suitable for use in the second stage of the present invention are those which are comprised of a crystalline zeolite having an average pore diameter less than about 0.7 nanometers (nm), said crystalline zeolite comprising from about 10 wt. % to about 50 wt. % of the total fluidized catalyst composition. It is preferred that the crystalline zeolite be selected from the family of medium pore size (<0.7 nm) crystalline aluminosilicates, otherwise referred to as zeolites. Of particular interest are the medium pore zeolites with a silica to alumina molar ratio of less than about 75:1, preferably less than about 50:1, and more preferably less than about 40:1. The pore diameter (also sometimes referred to as effective pore diameter) can be measured using standard adsorption techniques and hydrocarbonaccous compounds of known minimum kinetic diameters. See Breck, *Zeolite Molecular Sieves,* 1974 and Anderson et al., J. Catalysis 58, 114 (1979) both of which are incorporated herein by reference.

Medium pore size zeolites that can be used in the practice of the present invention are described in "Atlas of Zeolite Structure Types", eds. W. H. Meier and D. H. Olson, Butterworth-Heineman, Third Edition, 1992, which is hereby incorporated by reference. The medium pore size zeolites generally have a pore size from about 5 Å. to about 7 Å and include for example, MFI, MFS, MEL, MTW, EUO, MTT, HEU, FER, and TON structure type zeolites (IUPAC Commission of Zeolite Nomenclature). Non-limiting examples of such medium pore size zeolites, include ZSM-5, ZSM-12, ZSM-22, ZSM-23, ZSM-34, ZSM-35, ZSM-38, ZSM-48, ZSM-50, silicalite, and silicalite 2. The most preferred is ZSM-5, which is described in U.S. Pat. Nos. 3,702,886 and 3,770,614. ZSM-11 is described in U.S. Pat. No. 3,709,979; ZSM-12 in U.S. Pat. No. 3,832,449; ZSM-21 and ZSM-38 in U.S. Pat. No. 3,948,758; ZSM-23 in U.S. Pat. No. 4,076,842; and ZSM-35 in U.S. Pat. No. 4,016,245. All of the above patents are incorporated herein by reference. Other suitable medium pore size zeolites include the silicoaluminophosphates (SAPO), such as SAPO-4 and SAPO-11 which is described in U.S. Pat. No. 4,440,871; chromosilicates; gallium silicates; iron silicates; aluminum phosphates (ALPO), such as ALPO-11 described in U.S. Pat. No. 4,310,440; titanium aluminosilicates (TASO), such as TASO-45 described in EP-A No. 229,295; boron silicates, described in U.S. Pat. No. 4,254,297; titanium aluminophosphates (TAPO), such as TAPO-11 described in U.S. Pat. No. 4,500,651; and iron aluminosilicates. In one embodiment of the present invention the Si/Al ratio of said zeolites is greater than about 40.

The medium pore size zeolites can include "crystalline admixtures" which are thought to be the result of faults occurring within the crystal or crystalline area during the synthesis of the zeolites. Examples of crystalline admixtures of ZSM-5 and ZSM-11 are disclosed in U.S. Pat. No. 4,229,424 which is incorporated herein by reference. The crystalline admixtures are themselves medium pore size zeolites and are not to be confused with physical admixtures of zeolites in which distinct crystals of crystallites of different zeolites are physically present in the same catalyst composite or hydrothermal reaction mixtures.

The catalysts of the second stage of the present invention are held together with an inorganic oxide matrix component.

The inorganic oxide matrix component binds the catalyst components together so that the catalyst product is hard enough to survive interparticle and reactor wall collisions. The inorganic oxide matrix can be made from an inorganic oxide sol or gel which is dried to "glue" the catalyst components together. Preferably, the inorganic oxide matrix is not catalytically active and will be comprised of oxides of silicon and aluminum. It is also preferred that separate alumina phases be incorporated into the inorganic oxide matrix. Species of aluminum oxyhydroxides-g-alumina, boehmite, diaspore, and transitional aluminas such as a-alumina, b-alumina, g-alumina, d-alumina, e-alumina, k-alumina, and r-alumina can be employed. Preferably, the alumina species is an aluminum trihydroxide such as gibbsite, bayerite, nordstrandite, or doyelite.

Preferred second stage process conditions include temperatures from about 500° C. to about 650° C., preferably from about 525° C. to 600° C.; hydrocarbon partial pressures from about 10 to 40 psia, preferably from about 20 to 35 psia; and a catalyst to naphtha (wt/wt) ratio from about 3 to 12, preferably from about 4 to 10, where catalyst weight is total weight of the catalyst composite. It is also preferred that steam be concurrently introduced with the naphtha stream into the reaction zone, with the steam comprising up to about 50 wt. % of the hydrocarbon feed. Also, it is preferred that the naphtha residence time in the reaction zone be less than about 10 seconds, for example from about 1 to 10 seconds. The above conditions will be such that at least about 60 wt. % of the $C_5$+ olefins in the naphtha stream are converted to $C_4$− products and less than about 25 wt. %, preferably less than about 20 wt. % of the paraffins are converted to $C_4$− products, and that propylene comprises at least about 90 mol %, preferably greater than about 95 mol % of the total $C_3$ reaction products with the weight ratio of propylene/total $C_2$− products greater than about 3.5. It is also preferred that ethylene comprises at least about 90 mol % of the $C_2$ products, with the weight ratio of propylene-:ethylene being greater than about 4, and that the "full range" $C_5$+ naphtha product is enhanced in both motor and research octanes relative to the naphtha feed. It is within the scope of this invention that the catalysts of this second stage be precoked prior to introduction of feed in order to further improve the selectivity to propylene. It is also within the scope of this invention that an effective amount of single ring aromatics be fed to the reaction zone of said second stage to also improve the selectivity of propylene vs ethylene. The aromatics may be from an external source such as a reforming process unit or they may consist of heavy naphtha recycle product from the instant process.

The first stage and second stage regenerator flue gases are combined in one embodiment of this invention, and the light ends or product recovery section may also be shared with suitable hardware modifications. High selectivity to the desired light olefins products in the second stage lowers the investment required to revamp existing light ends facilities for additional light olefins recovery. The composition of the catalyst of the first stage is typically selected to maximize hydrogen transfer. In this manner, the second stage naphtha feed may be optimized for maximum $C_2$, $C_3$, and $C_4$ olefins yields with relatively high selectivity using the preferred second stage catalyst and operating conditions. Total high value light olefin products from the combined two stages include those generated with relatively low yield in the first stage plus those produced with relatively high yield in the second stage.

The following examples are presented for illustrative purposes only and are not to be taken as limiting the present invention in any way.

EXAMPLES 1–12

The following examples illustrate the criticality of process operating conditions for maintaining chemical grade propylene purity with samples of cat naphtha cracked over ZCAT-40 (a catalyst that contains ZSM-5) which had been steamed at 1500 F for 16 hrs to simulate commercial equilibrium. Comparison of Examples 1 and 2 show that increasing Cat/Oil ratio improves propylene yield, but sacrifices propylene purity. Comparison of Examples 3 and 4 and 5 and 6 shows reducing oil partial pressure greatly improves propylene purity without compromising propylene yield. Comparison of Examples 7 and 8 and 9 and 10 shows increasing temperature improves both propylene yield and purity. Comparison of Examples 11 and 12 shows decreasing cat residence time improves propylene yield and purity. Example 13 shows an example where both high propylene yield and purity are obtained at a reactor temperature and cat/oil ratio that can be achieved using a conventional FCC reactor/regenerator design for the second stage.

TABLE 1

| Example | Feed Olefins, wt % | Temp. ° C. | Cat/Oil | Oil psia | Oil Res. Time, sec | Cat Res. Time, sec | Wt. % $C_3^=$ | Wt. % $C_3^-$ | Propylene Purity, % |
|---|---|---|---|---|---|---|---|---|---|
| 1 | 38.6 | 566 | 4.2 | 36 | 0.5 | 4.3 | 11.4 | 0.5 | 95.8% |
| 2 | 38.6 | 569 | 8.4 | 32 | 0.6 | 4.7 | 12.8 | 0.8 | 94.1% |
| 3 | 22.2 | 510 | 8.8 | 18 | 1.2 | 8.6 | 8.2 | 1.1 | 88.2% |
| 4 | 22.2 | 511 | 9.3 | 38 | 1.2 | 5.6 | 6.3 | 1.9 | 76.8% |
| 5 | 38.6 | 632 | 16.6 | 20 | 1.7 | 9.8 | 16.7 | 1.0 | 94.4% |
| 6 | 38.6 | 630 | 16.6 | 13 | 1.3 | 7.5 | 16.8 | 0.6 | 96.6% |
| 7 | 22.2 | 571 | 5.3 | 27 | 0.4 | 0.3 | 6.0 | 0.2 | 96.8% |
| 8 | 22.2 | 586 | 5.1 | 27 | 0.3 | 0.3 | 7.3 | 0.2 | 97.3% |
| 9 | 22.2 | 511 | 9.3 | 38 | 1.2 | 5.6 | 6.3 | 1.9 | 76.8% |
| 10 | 22.2 | 607 | 9.2 | 37 | 1.2 | 6.0 | 10.4 | 2.2 | 82.5% |
| 11 | 22.2 | 576 | 18.0 | 32 | 1.0 | 9.0 | 9.6 | 4.0 | 70.6% |
| 12 | 22.2 | 574 | 18.3 | 32 | 1.0 | 2.4 | 10.1 | 1.9 | 84.2% |
| 13 | 38.6 | 606 | 8.5 | 22 | 1.0 | 7.4 | 15.0 | 0.7 | 95.5% |

| Example | Wt. % $C_2^=$ | Wt. % $C_2^-$ | Ratio of $C_3^-$ to $C_2^=$ | Ratio of $C_3^-$ to $C_2^-$ | Wt. % $C_3^=$ |
|---|---|---|---|---|---|
| 1 | 2.35 | 2.73 | 4.9 | 4.2 | 11.4 |
| 2 | 3.02 | 3.58 | 4.2 | 3.6 | 12.8 |
| 3 | 2.32 | 2.53 | 3.5 | 3.2 | 8.2 |

TABLE 1-continued

| | | | | | |
|---|---|---|---|---|---|
| 4 | 2.16 | 2.46 | 2.9 | 2.6 | 6.3 |
| 5 | 6.97 | 9.95 | 2.4 | 1.7 | 16.7 |
| 6 | 6.21 | 8.71 | 2.7 | 1.9 | 16.8 |
| 7 | 1.03 | 1.64 | 5.8 | 3.7 | 6.0 |
| 8 | 1.48 | 2.02 | 4.9 | 3.6 | 7.3 |
| 9 | 2.16 | 2.46 | 2.9 | 2.6 | 6.3 |
| 10 | 5.21 | 6.74 | 2.0 | 1.5 | 10.4 |
| 11 | 4.99 | 6.67 | 1.9 | 1.4 | 9.6 |
| 12 | 4.43 | 6.27 | 2.3 | 1.6 | 10.1 |
| 13 | 4.45 | 5.76 | 3.3 | 2.6 | 15.0 |

$C_2^- = CH_4 + C_2H_4 + C_2H_6$

The above examples (1,2,7 and 8) show that $C_3^=/C_2^=>4$ and $C_3^=/C_2^->3.5$ can be achieved by selection of suitable reactor conditions.

EXAMPLES 14–17

The cracking of olefins and paraffins contained in naphtha streams (e.g. FCC naphtha, coker naphtha) over small or medium pore zeolites such as ZSM-5 can produce significant amounts of ethylene and propylene. The selectivity to ethylene or propylene and selectivity of propylene to propane varies as a function of catlyst and process operating conditions. It has been found that propylene yield can be increased by co-feeding steam along with cat naphtha to the reactor. The catalyst may be ZSM-5 or other small or medium pore zeolites. Table 2 below illustrates the increase in propylene yield when 5 wt. % steam is co-fed with an FCC naphtha containing 38.8 wt. % olefins. Although propylene yield increased, the propylene purity is diminished. Thus, other operating conditions may need to be adjusted to maintain the targeted propylene selectivity.

TABLE 2

| Example | Steam Co-feed | Temp. C | Cat/Oil | Oil psia | Oil Res. Time, sec | Cat Res. Time, sec | Wt. % Propylene | Wt. % Propane | Propylene Purity, % |
|---|---|---|---|---|---|---|---|---|---|
| 14 | No | 630 | 8.7 | 18 | 0.8 | 8.0 | 11.7 | 0.3 | 97.5% |
| 15 | Yes | 631 | 8.8 | 22 | 1.2 | 6.0 | 13.9 | 0.6 | 95.9% |
| 16 | No | 631 | 8.7 | 18 | 0.8 | 7.8 | 13.6 | 0.4 | 97.1% |
| 17 | Yes | 632 | 8.4 | 22 | 1.1 | 6.1 | 14.6 | 0.8 | 94.8% |

What is claimed is:

1. A two stage process for selectively producing $C_2$ to $C_4$ olefins from a heavy hydrocarbonaceous feedstock, which process comprises:

a) reacting said feedstock, in a first stage comprised of a fluid catalytic cracking unit wherein it is converted in the presence of a large pore zeolitic catalytic cracking catalyst having an average pore diameter greater than about 0.7 nm and having a crystalline tetrahedral framework oxide component to lower boiling reaction products;

b) fractionating said lower boiling reaction products into various boiling point fractions, one of which is a naphtha boiling range fraction and one of which is a vapor fraction, c) reacting said naphtha boiling range fraction in a second reaction stage comprised of a process unit comprised of a reaction zone, a stripping zone, a catalyst regeneration zone, and a fractionation zone, wherein the naphtha boiling range fraction contains from about 10 to 30 wt. % paraffins and from about 15 to 70 wt. % olefins, and is contacted in the reaction zone with a catalyst containing from about 10 to 50 wt. % of a crystalline zeolite having an average pore diameter less than about 0.7 nm and silica to alumina molar ratio of less than about 75:1 at reaction conditions which include temperatures ranging from about 500 to 650° C. and a hydrocarbon partial pressure from about 10 to 40 psia, and a catalyst to feed ratio, by weight of about 4 to 10, and wherein propylene comprises at least about 90 mol. % of the total $C_3$ products;

d) collecting the resulting vapor products overhead and passing catalyst particles through the stripping zone wherein volatiles are stripped with steam;

e) passing the stripped catalyst particles to a regeneration zone where coke is burned from the catalyst; and f) recycling the hot regenerated catalyst particles to the reaction zone.

2. The process of claim 1 wherein the crystalline zeolite is selected from the group consisting of ZSM-5 and ZSM-11.

3. The process of claim 1 wherein the reaction temperature is from about 500° C. to about 600° C.

4. The process of claim 1 wherein at least about 60 wt. % of the $C_5$+ olefins in the naphtha boiling range fraction is converted to $C_4$− products and less than about 25 wt. % of the paraffins are converted to $C_4$− products.

5. The process of claim 6 wherein the weight ratio of propylene to total $C_2$− products is greater than about 3.5.

6. The process of claim 1 wherein the large pore zeolitic catalytic cracking catalyst of the first stage is selected from the group consisting of gmelinite, chabazite, dachiardite, clinoptilolite, faujasite, heulandite, analcite, levynite, erionite, sodalite, cancrinite, nepheline, lazurite, scolecite, natrolite, offretite, mesolite, mordenite, brewsterite, ferrierite and the synthetic zeolites X, Y, A, L, ZK-4, ZK-5, B, E, F, H, J, M, Q, T, W, Z, alpha, beta, and omega, and USY.

7. The process of claim 6 wherein the large pore zeolitic catalytic cracking catalyst is a USY zeolite.

8. The process of claim 1 wherein propylene comprises at least about 95 mol. % of the total of $C_3$ products.

* * * * *